US007505699B2

(12) United States Patent
Harada et al.

(10) Patent No.: US 7,505,699 B2
(45) Date of Patent: Mar. 17, 2009

(54) ELECTROPHOTOGRAPHIC IMAGE FORMING APPARATUS

(75) Inventors: Kinya Harada, Shizuoka-ken (JP); Koji Hashimoto, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 249 days.

(21) Appl. No.: 11/398,726

(22) Filed: Apr. 6, 2006

(65) Prior Publication Data

US 2006/0233560 A1 Oct. 19, 2006

(30) Foreign Application Priority Data

Apr. 13, 2005 (JP) ..... 2005-115989
Mar. 29, 2006 (JP) ..... 2006-092581

(51) Int. Cl.
*G03G 15/00* (2006.01)
*G03G 15/08* (2006.01)

(52) U.S. Cl. ..... 399/27; 399/119

(58) Field of Classification Search ..... 399/27, 399/29–30, 61–62, 111, 119, 263
See application file for complete search history.

(56) References Cited

U.S. PATENT DOCUMENTS

| | | | | |
|---|---|---|---|---|
| 5,327,196 | A | 7/1994 | Kato et al. | |
| 5,491,536 | A | 2/1996 | Mashiba et al. | 399/59 |
| 6,052,545 | A | 4/2000 | Komjiya et al. | 399/61 |
| 6,501,933 | B2 | 12/2002 | Ishii | 399/254 |
| 6,535,699 | B1 * | 3/2003 | Abe et al. | 399/27 |
| 7,010,237 | B2 * | 3/2006 | Suzuki et al. | 399/27 |
| 2004/0114946 | A1 * | 6/2004 | Koyama et al. | 399/27 |

FOREIGN PATENT DOCUMENTS

| | | |
|---|---|---|
| JP | 5-297720 | 11/1993 |
| JP | 7-104535 | 4/1995 |
| JP | 10-186769 | 7/1998 |
| JP | 2000-3569013 | 12/2000 |
| JP | 2003-241500 | 12/2000 |
| JP | 2001-215786 | 8/2001 |
| JP | 2001-350339 | 12/2001 |
| JP | 2003-131479 | 5/2003 |
| JP | 2003-295595 | 10/2003 |
| JP | 2004-177928 | 6/2004 |

* cited by examiner

*Primary Examiner*—Hoang Ngo
(74) *Attorney, Agent, or Firm*—Fitzpatrick, Cella, Harper & Scinto

(57) ABSTRACT

An image forming apparatus includes an image bearing member on which an electrostatic latent image is capable of being formed; a developer accommodating container for accommodating a developer for developing the electrostatic latent image; a detecting device for detecting a remaining amount of the developer in the developer accommodating container, wherein the detecting device detects the remaining amount during a period in which no image forming operation is performed; a developer stirring member for stirring the developer in the developer accommodating container, the developer stirring member being rotatable at a speed which is lower during detection of the remaining amount than when an image forming operation is performed, wherein the detecting device detects first, second and third developer remaining amounts in first, second and third remaining amount detecting periods, respectively, in the order named, and wherein an interval between the second detection period and the third detection period is changed on the basis of the first and second remaining amounts.

9 Claims, 9 Drawing Sheets

ELECTROPHOTOGRAPHIC IMAGE FORMING APPARATUS

FIELD OF THE INVENTION AND RELATED ART

The present invention relates to an electrophotographic image forming apparatus having a developer remainder amount detecting apparatus for detecting the amount of the developer remaining in a developer container in which developer is stored.

Here, an electrophotographic image forming apparatus means an apparatus that forms an image on recording medium with the use of an electrophotographic image forming method. As examples of an electrophotographic image forming apparatus, an electrophotographic copying machine, an electrophotographic printer (for example, laser beam printer, LED printer, etc.), facsimile machine, etc., can be included.

An electrophotographic image forming apparatus employing an electrophotographic image formation process in accordance with the prior art employs a process cartridge system, according to which an electrophotographic photosensitive member in the form of a drum (which hereinafter will be referred to as photosensitive drum) as an image bearing member, and a single or multiple processing means which process the photosensitive drum, are integrally disposed in a cartridge which is removably mountable in the main assembly of an electrophotographic image forming apparatus.

As one of the examples of the abovementioned processing means, there is a developing apparatus or the like which develops a latent image formed on the abovementioned photosensitive drum, with the use of developer (toner). A process cartridge system enables a user to maintain an electrophotographic image forming apparatus, with no help from service personnel, improving thereby an electrophotographic image forming apparatus in operational efficiency. Thus, a process cartridge system is widely used in the field of an electrophotographic image forming apparatus.

As for the timing of process cartridge replacement, generally, a process cartridge is replaced right after it becomes depleted of the toner therein. Further, as the amount of the toner in a process cartridge falls below a critical level, a user is informed that the process cartridge is close to the end of its life, being prompted to replace the process cartridge.

At this time, a toner remainder amount detecting method of the light transmission type, which is in accordance with the prior art, will be described.

A developer container for storing toner, that is, a toner container, is provided with a toner stirring member, which conveys the toner in the toner container to a supply roller, by being rotated while stirring the toner.

A toner container in which toner is stored is with provided with a pair of light transmission windows: top and bottom light transmission windows. The bottom light transmission window guides into the toner container the light from a light source, such as a light emitting diode (LED) or the like, with which the main assembly of an image forming apparatus is provided. The top light transmission window is a window which constitutes a light passage which guides the light guided into the toner container through the bottom window, toward a light quantity detection sensor, such as a phototransistor, located inside the image forming apparatus main assembly, in a location different from where the light source is located.

The bottom light transmission window is located below the rotational axis of the stirring member, whereas the top light transmission window is located above the rotational axis of the stirring member. Each time the stirring member is rotated, it comes into contact with the bottom and top light transmission windows, wiping away the toner that has adhered to the inward side of each window. As the amount of the toner within the sweeping range of the stirring member is reduced by toner consumption, the light is allowed to transmit through the toner container from the bottom light transmission window to the top light transmission window, making it possible to detect the amount of the toner remainder.

It has been known that there is a correlation between the amount of the toner in the toner container and the length of time the light is allowed to transmit through the toner container per full rotation of the stirring member. This fact is utilized to continuously detect the amount of the toner remainder in the toner container. In this case, the cleanliness of the bottom and top light transmission windows is important. It is also important that there is a stable relationship between the manner in which the body of toner in the adjacencies of the bottom light transmission window re-covers the bottom light transmission window after the sweeping of the window by the stirring member, and the amount of the toner remainder in the toner container.

Therefore, various proposals have been made to devise the stirring member in terms of the size and pattern of the wiping range.

SUMMARY OF THE INVENTION

The present invention is an invention related to an image forming apparatus which detects the amount of developer remainder using a method such as the above described one. The primary object of the present invention is to detect the amount of developer remainder in a developer container, with such timing that makes it possible to accurately detect the amount of the developer in the developer container, without unnecessarily reducing in productivity an image forming apparatus which detects the amount of developer remainder while no image is formed, and which reduces the rotational speed of its developer stirring member when detecting the amount of developer remainder.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Figure 1:
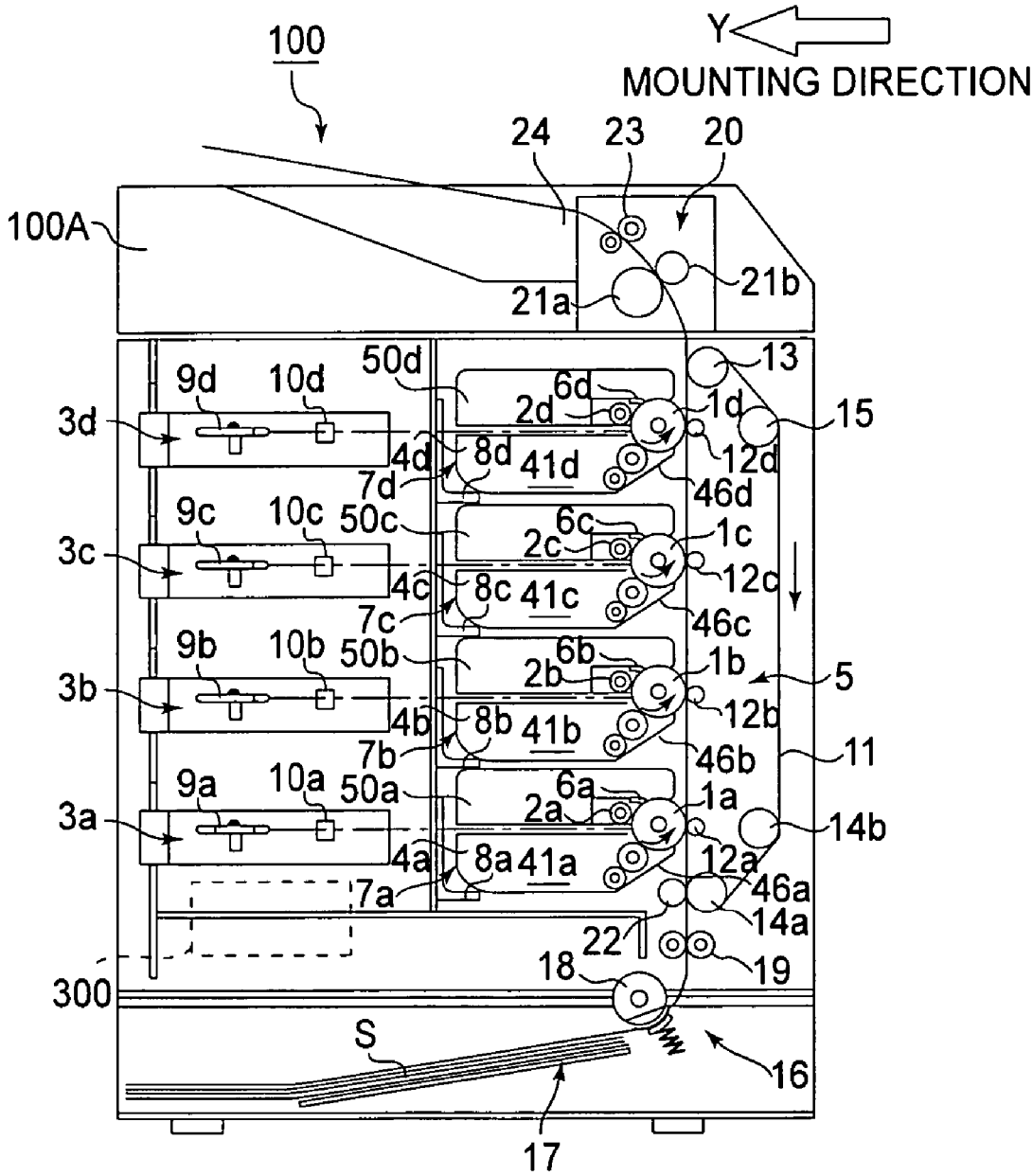
FIG. 1 is a schematic sectional view of the electrophotographic image forming apparatus in the first embodiment of the present invention, showing the general structure thereof.

Hereinafter, an electrophotographic multicolor image forming apparatus as an embodiment of an electrophotographic image forming apparatus in accordance with the present invention will be described in detail with reference to the appended drawings. The embodiments which will be described below are presented for concretely describing the present invention. The measurements, materials, and shapes of the structural components listed below, their positional relationship, etc., are not intended to limit the scope of the present invention, unless specifically noted.

Embodiment 1

(General Structure of Image Forming Apparatus)

First, referring to FIG. 1, the general structure of the electrophotographic multicolor image forming apparatus in this embodiment will be described.

The electrophotographic multicolor image forming apparatus shown in the drawing has four process cartridge bays 8 (8*a*, 8*b*, 8*c*, and 8*c*), which are vertically stacked in parallel, and in which process cartridges 7 (7*a*, 7*b*, 7*c*, and 7*d*) are mounted respectively. The process cartridges are provided with electrophotographic photosensitive members in the form of a drum, that is, photosensitive drums (image bearing members) 1 (1*a*, 1*b*, 1*c*, and 1*d*), respectively.

Each photosensitive drum 1 is rotationally driven by a driving means (unshown) in the counterclockwise direction of FIG. 1. In the adjacencies of the peripheral surface of the photosensitive drum 1, the following structural components are disposed in the order in which they will be listed, in terms of the rotational direction of the photosensitive drum 1.

They are: charging means 2 (2*a*, 2*b*, 2*c*, and 2*d*) for uniformly charging the peripheral surfaces of the photosensitive drums 1 (one for one); scanner units 3 (3*a*, 3*b*, 3*c*, and 3*d*) for forming electrostatic latent images on the peripheral surfaces of the photosensitive drums 1, one for one, by projecting a beam of laser light while modulating it with image formation information; development units 4 (4*a*, 4*b*, 4*c*, and 4*d*) having developing means for developing the electrostatic latent image with the use of toner as developer; an electrostatic transferring means 5 for transferring the toner images on the photosensitive drums 1 onto a sheet of recording medium S (which hereinafter will be referred to simply as recording medium S); and cleaning means 6 (6*a*, 6*b*, 6*c*, and 6*d*) for removing the toner remaining on the peripheral surfaces of the photosensitive drums 1, one for one.

Each photosensitive drum 1 and corresponding charging means 2, development unit 4, and cleaning means 6, are integrally disposed in a cartridge, making up a process cartridge 7. The process cartridge 7 in this embodiment is made up of a photosensitive member unit 50 and a development unit 4, which are separable from each other. The photosensitive member unit 50 is made up of the photosensitive drum 1, charging means 2, cleaning means 6, and a frame (first frame) to which the preceding components are attached, whereas the development unit 4 is made up of the developing means, and a frame (second frame) to which the developing means is attached.

The photosensitive drum 1 is made up of an aluminum cylinder, which is 30 mm, for example, in diameter, and an organic photoconductive layer (photosensitive layer formed of OPC) coated on the peripheral surface of the aluminum cylinder. The photosensitive drum 1 is rotatably supported at the lengthwise ends by a pair of supporting members. To one of the lengthwise ends of the photosensitive drum 1, driving force is transmitted from a motor (unshown), whereby the photosensitive drum 1 is rotationally driven in the counterclockwise direction.

Figure 2:
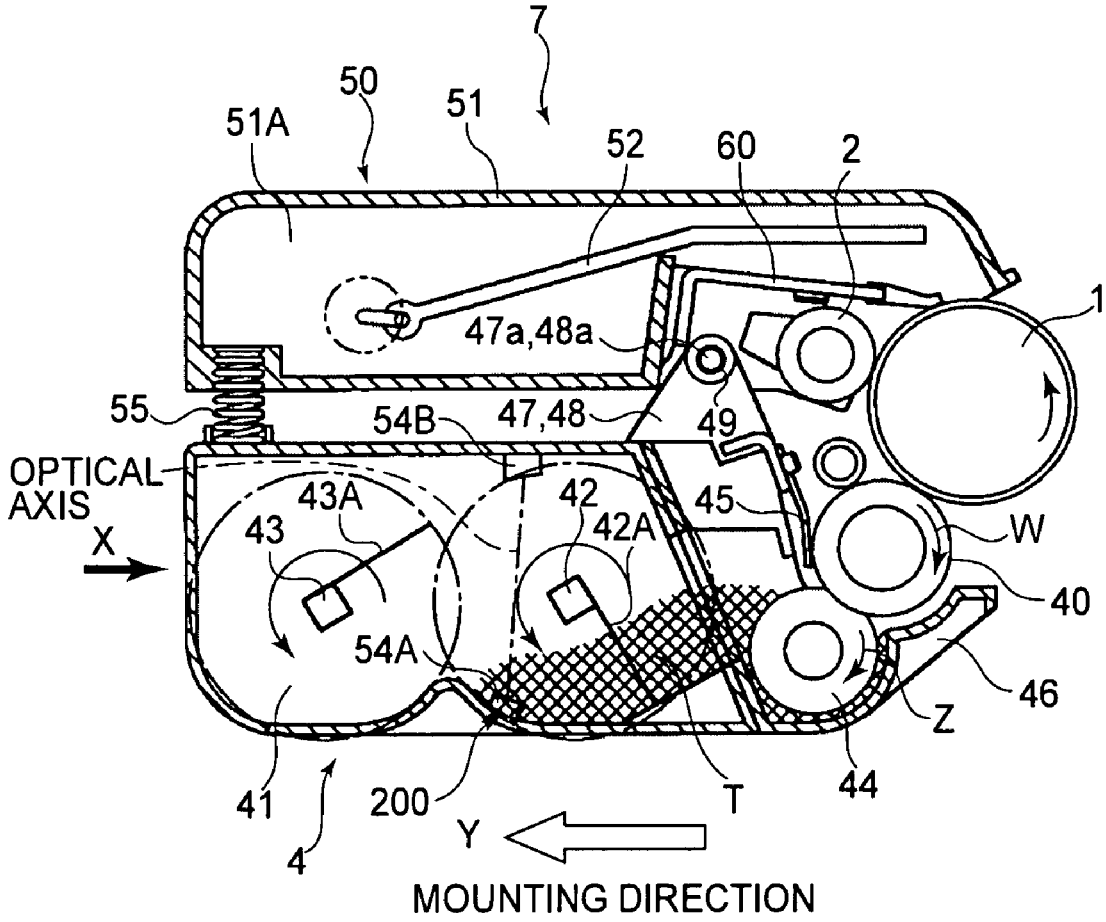
FIG. 2 is a sectional view of the process cartridge in the first embodiment of the present invention, showing the general structure thereof.

Referring to FIG. 2, as the charging means 2, a charging means of the contact type is employed; the charging means 2 is in the form of an electrically conductive roller, that is, a charge roller, which is placed in contact with the peripheral surface of the photosensitive drum 1. To the charge roller 2, charge bias voltage is applied to uniformly charge the peripheral surface of the photosensitive drum 1.

The scanner units 3 (3*a*, 3*b*, 3*c*, and 3*d*) are positioned approximately at the same level relative to the corresponding photosensitive drums 1. A beam of image formation light is projected from the laser diode of each scanner unit 3, while being modulated with video signals, to the corresponding polygon mirror (9*a*, 9*b*, 9*c*, or 9*d*), which is being rotated by a scanner motor (unshown). The beam of image formation light deflected by the polygon mirror 9 selectively exposes the numerous points on the charged peripheral surface of the photosensitive drum 1, through a focal lens 10 (10*a*, 10*b*, 10*c*, or 10*d*), effecting thereby an electrostatic latent image which reflects the video signals.

Referring to FIG. 1, each development unit 4 has a developer container 41 and a development unit frame 46. The developer container 41 contains toner, which is different in color from the toner in the developer containers 41 of the other development units 4. In other words, there are developer container 41*a* storing the toner of yellow color, a developer container 41*b* storing the toner of cyan color, a developer container 41*c* storing the toner of magenta color, and a developer container 41*d* storing the toner of black color.

Referring again to FIG. 2, the toner T stored in each of the developer containers 41 (41*a*, 41*b*, 41*c*, and 41*d*) is sent to a supply roller 44 by first and second stirring members 42 and 43, as toner stirring members, disposed in the developer container 41.

In the adjacencies of the supply roller 44, a development roller 40, as a developer bearing member, is disposed. The development roller 40 bears developer, and develops an electrostatic latent image on the photosensitive drum 1, into a developer image (toner image), that is, an image formed of developer (toner). Also disposed in the developer container 41 is a development blade 45, which is kept pressed upon the peripheral surface of the development roller 40. The toner in the developer container 41 is coated on the peripheral surface of the development roller 40 by the supply roller 44 and development blade 45, while being given electric charge. Thus, as development bias is applied to the development roller 40, the electrostatic latent image formed on the photosensitive drum 1 is developed. Incidentally, the development roller 40 is disposed so that the peripheral surface of the development roller 40 directly opposes that of the photosensitive drum 1.

Also referring to FIG. 1, the image forming apparatus 100 is provided with an electrostatic transfer belt 11, which circularly moves while remaining in contact with all of the photosensitive drums 1 (1*a*, 1*b*, 1*c*, and 1*d*). The recording medium S is conveyed by the transfer belt 11 to transfer locations, at which the toner image on the photosensitive drum 1 is transferred onto the recording medium S.

The image forming apparatus 100 is also provided with transfer rollers 12 (12*a*, 12*b*, 12*c*, and 12*d*), which are disposed in parallel so that they oppose the four photosensitive drums 1 (1*a*, 1*b*, 1*c*, and 1*d*), respectively, with the transfer belt 11 sandwiched between the transfer rollers 12 and photosensitive drums 1. From the transfer rollers 12, electric charge which is opposite in polarity to the toner T is applied to the recording medium S through the transfer belt 11. As a result, the toner images on the photosensitive drums 1 are transferred onto the recording medium S. The transfer belt 11 is stretched around, being thereby suspended by, four rollers, which are a driver roller 13, follower rollers 14*a* and 14*b*, and a tension roller 15, and is circularly moved (in the direction indicated by arrow mark in FIG. 1). As the transfer belt 11 is circularly moved, the recording medium S is conveyed from the follower roller 14*a* side to the driver roller 13 side, and while the recording medium S is conveyed, the toner images are transferred onto the recording medium S.

Designated by a referential symbol 16 is a portion by which the recording medium S is fed into the main assembly of the image forming apparatus, and conveyed to the image forming portions. More specifically, multiple recording mediums S are stored in a feeder cassette 17. When the image forming apparatus is in an image forming operation, a feed roller 18 and a pair of registration rollers 19 are rotationally driven in synchronism with the progression of the image forming operation, whereby the recording mediums S in the feeder cassette 17 are fed into the image forming apparatus main assembly while being separated one by one, and are further conveyed into the main assembly. Each recording medium S is conveyed until its leading edge comes into contact with the pair of registration rollers 19. As the leading edge of the recording medium S comes into contact with the registration rollers 19, it is temporarily held there by the registration rollers 19. Then, it is released by the registration roller 19 in synchronism with the circular movement of the transfer belt 11, and is further conveyed by the registration rollers 19 to the transfer belt 11.

A fixing portion 20 is a portion for fixing multiple monochromatic toner images, different in color, which have been transferred onto the recording medium S. The fixing portion 20 has a pair of fixation rollers 21, which are a rotatable heat roller 21*a* and a rotatable pressure roller 21*b*. The pressure roller 21*b* is kept pressed upon the heat roller 21*a* to apply heat and pressure to the recording medium S. After the transfer of the toner images on the photosensitive drums 1 onto the recording medium S, the recording medium S is conveyed through the fixing portion 20 by the pair of fixation rollers 21, while being subjected to the heat and pressure applied by the pair of fixation rollers 21. As a result, the multiple monochromatic toner images different in color are fixed to the surface of the recording medium S.

Thereafter, the recording medium S is discharged from the main assembly of the image forming apparatus by a pair of discharge rollers 23 through a recording medium outlet 24.

(Process Cartridge)

Next, referring to FIGS. 2 and 3, the process cartridges 7 (7*a*, 7*b*, 7*c*, and 7*d*), in this embodiment, mountable in the image forming apparatus main assembly A will be described.

Incidentally, the process cartridge 7*a* storing the toner of yellow color, process cartridge 7*b* storing the toner of cyan color, process cartridge 7*c* storing the toner of magenta color, and process cartridge 7*d* storing the toner of black color are identical in structure. FIG. 2 is a sectional view of the process cartridge 7 (7*a*, 7*b*, 7*c*, and 7*d*), at a plane perpendicular to the lengthwise direction of the process cartridge 7.

As for the photosensitive drum unit 50, the photosensitive drum 1 is rotatably attached to the cleaning means frame 51, with the bearings 31 (31*a* and 31*b*) (FIG. 3) placed between the photosensitive drum 1 and cleaning means frame 51. In the adjacencies of the peripheral surface of the photosensitive drum 1, the charge roller 2 for uniformly charging the peripheral surface of the photosensitive drum 1, and a cleaning blade 60 for removing the toner T remaining on the peripheral surface of the photosensitive drum 1, are disposed. As the residual toner, or the toner remaining on the peripheral surface of the photosensitive drum 1, is removed from the peripheral surface of the photosensitive drum 1, it is sent by a toner conveyance mechanism 52 to a waste toner chamber 51*a* located in the rear portion of the cleaning means frame 51. Meanwhile, the photosensitive drum 1 is rotationally driven in the counterclockwise direction of the drawing, in synchronism with the progression of the image forming operation.

The development unit 4 is provided with: the development roller 40 as a developer bearing member, which rotates in the direction indicated by an arrow mark W while remaining in contact with the photosensitive drum 1; the developer container 41 storing the toner; and a development unit frame 46. The development roller 40 is rotatably supported by the development unit frame 46, with the bearings (unshown) placed between the development roller 40 and development unit frame 46. In the adjacencies of the development roller 40, the supply roller 44, which rotates in the direction indicated by an arrow mark Z while remaining in contact with the development roller 40, and a development blade 45 as a developer regulating member, are disposed.

Further, in the developer container 41, first and second stirring members 42 and 43 are disposed, which are for conveying the toner to the supply roller 44 while stirring it.

The development unit 4 is attached to the photosensitive drum unit 50, with pins 49, as if the development unit 4 were hung in entirety from the photosensitive drum unit 50 so that it is pivotally movable about the pins 49. Prior to the mounting of the process cartridge 7 into the image forming apparatus main assembly 100, the development roller 40 is kept pressed on the photosensitive drum unit 50 by compression springs 55, whereby the development roller 40 is kept in contact with the photosensitive drum 1 by the moment generated by the springs 55 in the direction to rotate the development unit 4 about the pins 49 which function as the development unit supporting shafts.

The process cartridge 7 is also provided with a side cover 72 (FIG. 4), which is located outward of the development unit 4. One of the end surfaces of the photosensitive drum unit 50, and the corresponding side cover 72 of the development unit 4, make up one of the two end surfaces of the process cartridge 7. The other end surface of the photosensitive drum unit 50, and the corresponding side cover 72 of the development unit 4, make up the other end surface of the process cartridge 7.

In a development operation, the toner in the development unit 4 is conveyed to the supply roller 44 by the first and second stirring members 42 and 43. As the toner is conveyed to the supply roller 44, the toner is borne on the peripheral surface of the supply roller 44 which is being rotated in the direction indicated by an arrow mark Z in the drawing. As a result, the toner on the supply roller 44 is transferred onto the development roller 40, becoming borne on the development roller 40 as the supply roller 44 rubs against the development roller 40 which is rotating in the direction indicated by an arrow mark W in the drawing.

As the development roller 40 is rotated, the toner borne on the development roller 40 reaches the development blade 45, which regulates the toner on the development roller 40 so that a thin layer of toner with a preset thickness is formed on the peripheral surface of the development roller 40. As the development roller 40 is further rotated, the thin layer of toner reaches the development portion, that is, the area in which the photosensitive drum 1 and development roller 40 are in contact with each other. In the development portion, the toner is adhered to the electrostatic latent image on the peripheral surface of the photosensitive drum 1, by the development bias (which is DC voltage) applied to the development roller 40 from an electric power source (unshown); in other words, the electrostatic latent image is developed by the DC voltage. As the development roller 40 is further rotated, the toner remaining on the peripheral surface of the development roller 40, that is, the toner on the development roller 40, which did not contribute the development, is returned to the development unit frame 46, in which it is separated from the development roller 40, in the area in which the development roller 40 and supply roller 44 rub against each other, being thereby recovered into the developer unit frame 46. The recovered toner is mixed with the toner in the development unit frame, by the first and second stirring members 42 and 43.

In the case of a developing method of the contact type such as the one in this embodiment, in which a latent image on the photosensitive drum 1 is developed by placing the development roller 40 in contact with the peripheral surface of the photosensitive drum 1, it is desired that the photosensitive drum 1 is a rigid member, whereas the development roller 40 is a roller having an elastic layer. As the elastic layer of the development roller 40, a plain solid rubber layer, or a solid rubber layer coated with resin or the like, is desirable, in consideration of the function required of the development roller 40, which is to electrically charge the toner.

The process cartridge 7 is mounted into the image forming apparatus main assembly 100A in the following manner. Here, the lengthwise direction means the direction parallel to the axial line of the photosensitive drum 1, and the cross-sectional direction means the direction perpendicular to the axial line of the photosensitive drum 1.

Figure 3:
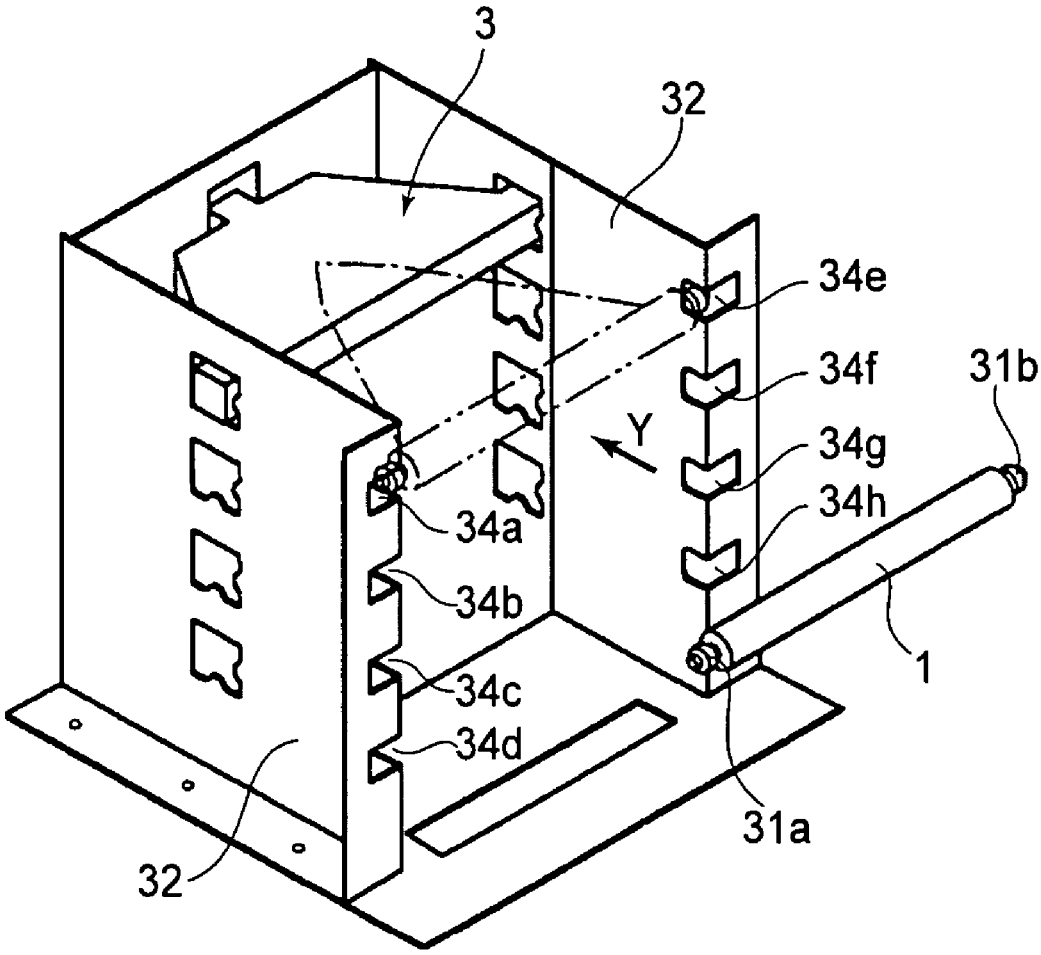
FIG. 3 is a perspective view of the main assembly of the image forming apparatus, and one of the process cartridges, showing the manner in which the process cartridge is mounted into the main assembly.
Figure 4:
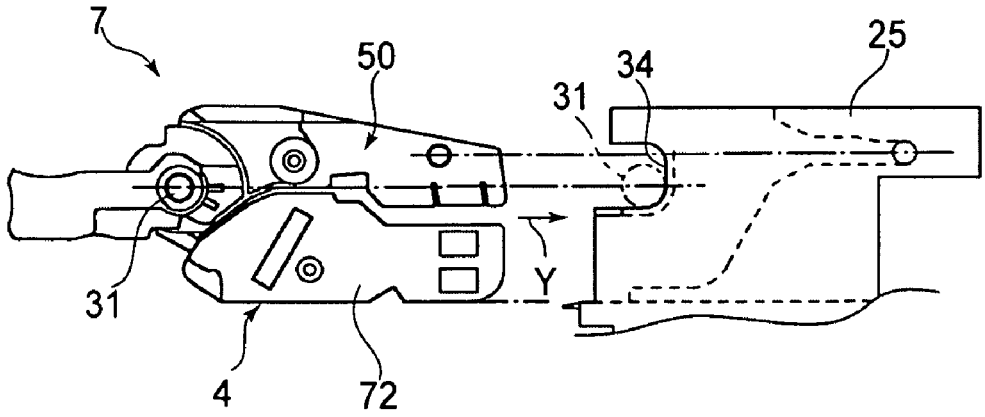
FIG. 4 is a side view of a part of the image forming apparatus main assembly, and one of the process cartridges, showing the manner in which the process cartridge is mounted into the main assembly.

Referring to FIGS. 3 and 4, in order to properly mount the process cartridge 7 into the image forming apparatus main assembly 100A, the process cartridge 7 is to be inserted into to the apparatus main assembly 100A from the direction indicated by an arrow mark Y, along the process cartridge guide 25, so that the bearings 31 (31*a* and 31*b*) which support the photosensitive drum 1 fit into guiding grooves 34 (34*a*, 343; 34*b*, 34*f*; 34*c*, 34g; and 34*d*, 34*h*), respectively.

Figure 6:
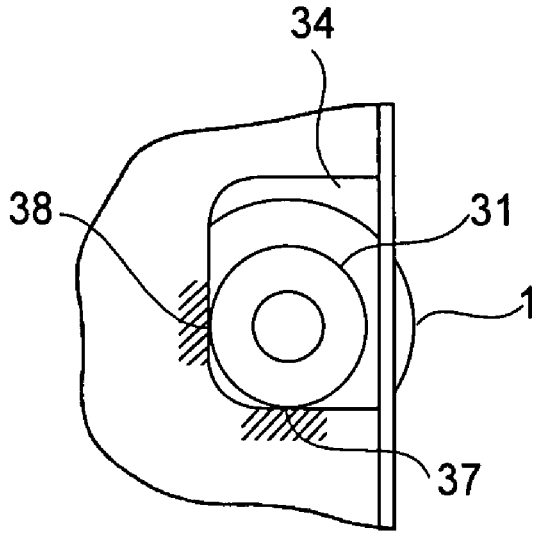
FIG. 6 is a side view of one of the photosensitive drum bearings, and its adjacencies, showing the manner in which the drum bearing is positioned relative to the image forming apparatus main assembly as the process cartridge is mounted into the apparatus main assembly.

Next, referring to FIG. 6, as the process cartridge 7 is further inserted, each bearing 31 comes into contact with the bearing catching surfaces 37 and 38 (drum bearing positioning surfaces) of the guiding groove 34, accurately positioning the process cartridge 7 relative to the apparatus main assembly 100A. As for the position of the process cartridge 7 in terms of the lengthwise direction, until the last stage of the cartridge insertion, the process cartridge 7 is kept approximately positioned relative to the apparatus main assembly 100A by the guiding member 25 of the apparatus main assembly, and the lengthwise end surface of the process cartridge 7. Then, in the last stage of the cartridge insertion, the positioning portion of the end surface of the drum unit is pressed on a predetermined area of the image forming apparatus main assembly 100A, in the direction perpendicular to the lateral wall of the image forming apparatus main assembly 100A, by a pressing means (unshown). As a result, the process cartridge 7 is accurately positioned relative to the apparatus main assembly 100A in terms of the lengthwise direction.

Figure 5:
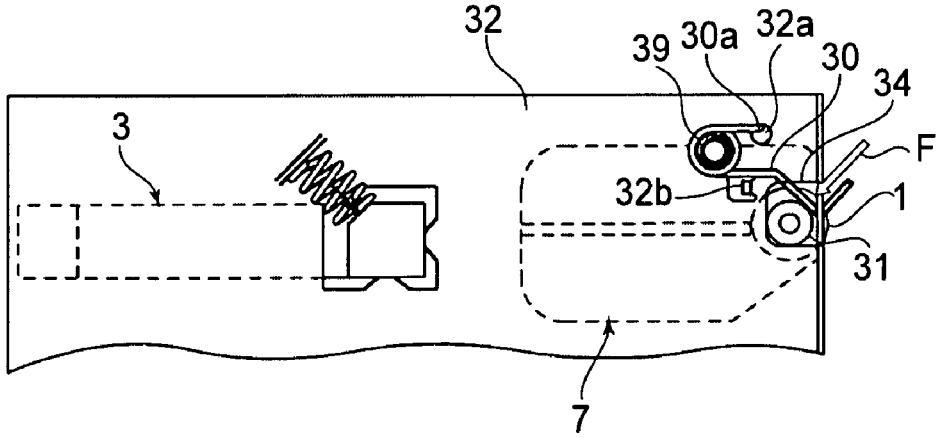
FIG. 5 is a partially phantom side view of a part of the image forming apparatus main assembly, and one of the process cartridges, showing the manner in which the process cartridge is mounted into the main assembly.

As for the method for keeping the process cartridge 7 accurately positioned in the image forming apparatus main assembly 100A in terms of the cross-sectional direction, the setup shown in FIG. 5 is employed.

That is, each of left and right lateral plates 32 is provided with a shaft 39, which is attached the lateral plate 32 by crimping. The shaft 39 is fitted with a torsional coil spring 30, the one end 30*a* of which is fitted in a hole 32*a* of the corresponding side plate 32. Prior to the mounting of the process cartridge 7 into the image forming apparatus main assembly 100A, the drum bearing positioning portion of the torsional coil spring 30, which is the opposite end portion of the spring 30 from the end portion fitted in the abovementioned hole 32*a* of the side plate 32, is retained by a projection 32*b* of the corresponding lateral plate 32, being preventing from rotating in the unwinding direction of the coil spring 30. As the process cartridge 7 is inserted into the image forming apparatus main assembly 100A, the drum bearing positioning portion of the torsional coil spring 30 is pressed by the drum bearing of the process cartridge 7, being thereby rotated in the clockwise direction against the resiliency of the torsional coil spring 30. As soon as the downwardly pointing portion of the drum bearing positioning portion of the torsional coil spring 30 slides over the bearing 31, it snaps into the position shown in FIG. 5, accurately positioning the process cartridge 7 by pressing the bearing 31 in the direction indicated by an arrow mark F.

Next, referring to FIGS. 2, and 7-9, the main feature of the present invention, that is, the method for detecting the amount of the developer (toner) remainder in the toner container by transmitting a beam of light through the toner container, and the structure of a detecting apparatus 200 which detects the amount of the developer (toner) remainder by transmitting a beam of light through the toner container, will be described.

(Detection of Toner Remainder Amount Based on Duration of Light Transmission)

Referring to FIG. 2, in the developer container 41 for storing the toner T, the development roller 40, supply roller 44, and first and second stirring rollers 42 and 43 are disposed. The first stirring member 42 is closer to the supply roller 44 than the second stirring member 43. The stirring members 42 and 43 are rotated at the same speed, with the provision of a preset amount of difference in rotational phase between the two stirring members 42 and 43. As the two stirring members 42 and 43 are rotated as described above, the toner T is conveyed to the supply roller 44. As toner consumption continues, the amount of the toner T in the developer container 41 eventually reduces to the amount just enough to fill the adjacencies of the peripheral surface of the supply roller 44 and the adjacencies of the bottom portion of the first stirring member 42, as shown in FIG. 2.

Figure 7:
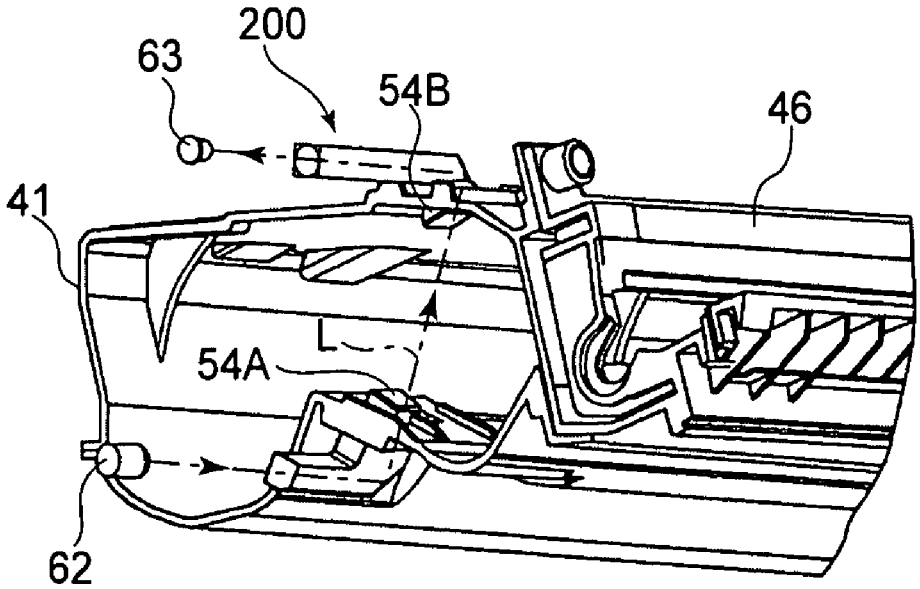
FIG. 7 is a perspective cutaway view of the process cartridge, showing the light passage through which the beam of light projected to detect the developer remainder amount travels.

Referring to FIGS. 2 and 7, the developer container 41 for storing the toner T is provided with a pair of light transmission windows 54A and 54B, which constitutes a part of the toner remainder amount detecting apparatus 200. More specifically, the bottom light transmission window 54*a* is located below the axial line of the first stirring member 42, and the top light transmission window 54B is located above the rotational axis of the first stirring member 42. The two light transmission windows 54A and 54B are structured so that they slightly project inward of the developer container 41. This pair of light transmission windows 54A and 54B constitute parts of the light passage through which a beam of light is transmitted to detect the amount of the toner T remaining in the developer container 41.

As the first stirring member 42 is rotated, the sheet portion 42*a* of the first stirring member 42 rubs the top and bottom light transmission windows 54B and 54A, wiping away the toner T which has adhered to the inward sides of the windows 54B and 54A.

As for the method employed by the detecting apparatus 200 in this embodiment, a beam of light L is emitted from a light emitting portion 62 made up of a light emitting diode (LED) or the like attached to the image forming apparatus main assembly 100A (this beam of light L hereafter will be referred to as detection light L). The detection light L transmits through the bottom light transmission window 54A and the top light transmission window 54B, reaching a light receiving portion 63 made up of a phototransistor or the like, which catches the detection light L. The light receiving portion 63 is attached to the image forming apparatus main assembly 100A.

Figure 8:
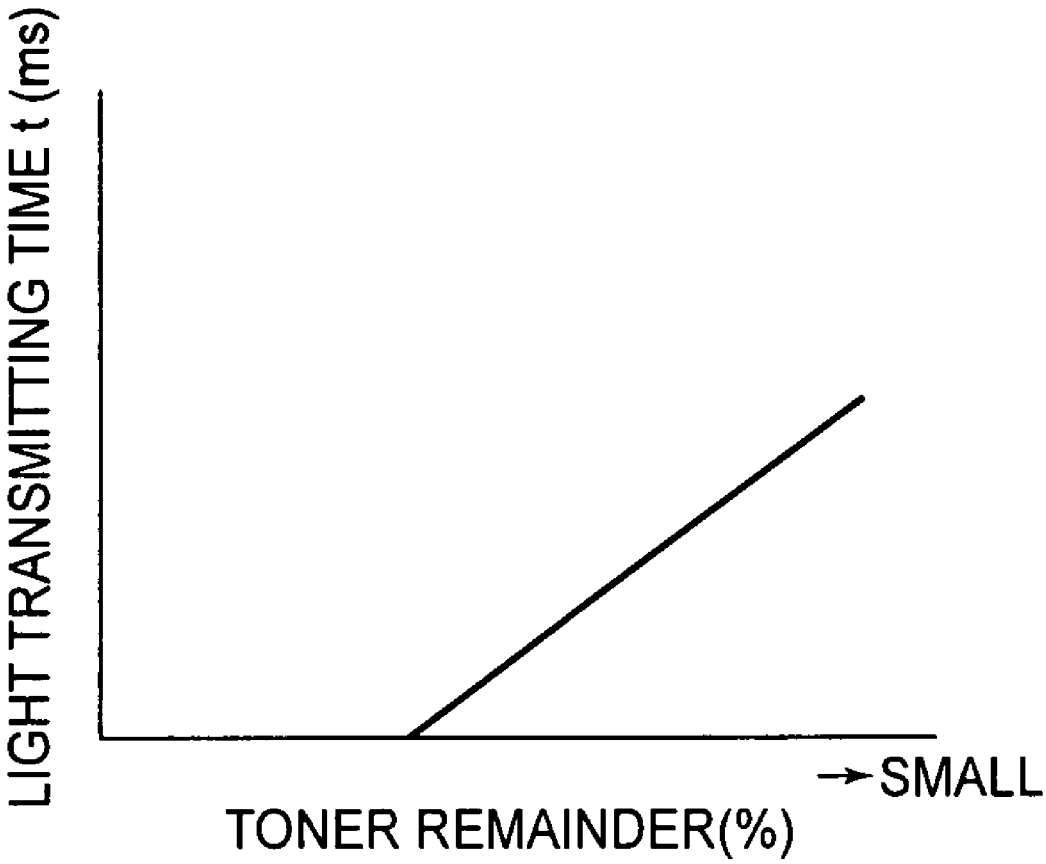
FIG. 8 a graph showing the relationship between the amount of toner remainder and the length of time the beam of light is allowed to transmit through the toner container.

The relationship between the amount of toner T in the developer container 41 and the length of time t the detection light L is allowed to transmit through the developer container 41 is shown in FIG. 8. The smaller the amount of the toner T in the developer container 41, the longer the length of time (light transmission duration) the detection light L is received by the light receiving portion 63; the larger the amount of the toner T in the developer container 41, the shorter the length of time the detection light L is received by the light receiving portion 63. In other words, the length of time the detection light L is received by the light receiving portion 63 is inversely proportional to the amount of the toner T remaining in the developer container 41. The CPU uses the signal reflecting the duration of this detection light reception by the light receiving portion 63 to calculate the amount (percentage) of the toner remainder. Here, the percentage of the toner remainder means the percentage of the amount of the toner remainder relative to the initial amount (100%) of the toner in the developer container 41, that is, the amount of the toner T in the developer container 41 when the developer container 41 is full.

Incidentally, in recent years, an electrophotographic image forming apparatus has been substantially increased in printing speed (process speed) every year. With the increase in process speed, the amount by which toner is supplied to a development roller has to be increased accordingly. Therefore, the rotational speed of a stirring member has also to be set to a faster speed proportional to the increased process speed. The increase in the rotational speed of a stirring member affects the length of time the abovementioned detection light is allowed to transmit through the toner container, because the change in the rotational speed of a stirring member affects the fluidity of the toner which is being stirred in the toner container.

That is, when the rotational speed of the toner stirring member is slow, toner is not stirred much, and therefore, the amount by which air is mixed into toner is relatively small, leaving toner relatively low in fluidity. On the contrary, when the rotational speed of the toner stirring member is higher, the toner in the toner container is stirred more frequently, and therefore, a larger amount of air is mixed into the toner, rendering the toner higher in fluidity than when the rotational speed of the toner stirring member is lower.

As soon as the body of toner on the surface of the light transmission window is wiped away from the window, it moves back to the window and re-covers it. In terms of this movement, a body of toner which is low in fluidity is relatively stable compared to a body of toner which is high in fluidity. Thus, when the toner stirring member is slow in rotational speed, that is, when the toner in the toner container is low in fluidity, the length of time the detection light is allowed to transmit through the toner container remains relatively consistent, making it possible to accurately detect the amount of the toner remainder in the toner container.

On the other hand, when a body of toner is high in fluidity, it is unstable in its behavior. Therefore, it quickly re-covering the light transmission window, after the sheet portion of the toner stirring member wipes the surface of the light transmission window. Therefore, not only is the length of time the detection light is allowed to transmit through the toner container is shorter, but also, it is inconsistent, making it impossible to accurately detect the amount of the toner remainder in the toner container.

In this embodiment, therefore, in order to solve the above described problem, the toner stirring member is reduced in rotational speed before starting to detect the amount of the toner remainder in the toner container. In other words, the amount of the toner remainder is detected when the toner remainder is lower in fluidity. However, the developer roller must be continuously supplied with a preset amount of toner. Thus, in order to ensure that the development roller is continuously supplied with the preset amount of toner, the amount of the toner remainder in the toner container must be detected during a period other than the period in which an image is actually formed.

Further, it takes a certain amount of time to detect the amount of the toner remainder. Therefore, if the amount of toner remainder is frequently detected, that is, if the intervals with which the amount of toner remainder is detected are reduced in length, the image forming apparatus reduces in productivity. Thus, the timing with which the amount of the toner remainder is detected must be set in order to prevent the image forming apparatus from being unnecessary reduced in productivity.

On the contrary, if the intervals with which the amount of the toner remainder is detected are excessively increased in length, the following problem occurs. That is, if the amount of toner consumed for image formation during each of the toner remainder amount detection intervals is substantial, the amount of the toner remainder detected by a given toner remainder amount detecting operation is substantially different from that detected by the immediately preceding toner remainder amount detecting operation. Therefore, it is possible that the proper timing for detecting the toner depletion will be missed.

If a printing operation is continued in spite of toner depletion, because there is a delay between the time of toner depletion and the time at which a user is informed of the toner depletion, it is possible that defective images will be yielded. Further, a user may miss the proper opportunity at which the process cartridge is to be replaced.

In this embodiment, therefore, in consideration of the above described reasons, the sequence for detecting the amount of toner remainder in the toner container is carried out with such intervals that are inversely proportional in length to the amount of toner consumption.

(Remainder Amount Detection Sequence)

In this embodiment, the periods in which the amount (calculated in percentage) of the toner remainder is detected by the toner remainder amount detecting apparatus 200 of the light transmission type are such periods that are other than the periods in which images are actually formed. More specifically, the amount of the toner remainder is detected at the end of an image forming operation during which a cumulative length of time of the development roller rotation reaches a preset value.

Here, an "image forming operation" means an operation for developing, with the use of the toner T borne on the development roller 40, an electrostatic latent image formed on the peripheral surface of the photosensitive drum 1 by exposing (scanning) the peripheral surface of the photosensitive drum 1 with a beam of laser light while modulating it with image formation information. "While an image is actually formed" means while an electrostatic latent image on the photosensitive drum 1 is developed with the toner T borne on the development roller, whereas "while no image is actually formed" means a period other than the period in which an image is actually formed, in other words, while an electrostatic latent image on the photosensitive drum 1 is not developed. Moreover, the image forming apparatus is set up so that as the cumulative length of time of the rotation of the development roller 40 reaches a preset value Ts, the counter for the cumulative length of time of the rotation of the development roller 40 is reset to start accumulating the length of time of the development roller rotation from zero.

The reason why the amount of the toner remainder is detected while no image is formed is that unlike while an image is actually formed, while no image is actually formed, it is possible to set lower the rotational speed of the first stirring member, because while no image is actually formed, it does not occur that a defective image is formed because of the insufficiency in the amount of the toner supplied to the development roller 40. In this embodiment, while an image is actually formed, the rotational speed of the first stirring member 42 is set to roughly 60 rpm, whereas while the amount of the toner remainder is detected, it is set to roughly 30 rpm, that is, ½ the rotational speed of the first stirring member set for the period in which an image is actually formed.

By reducing the rotational speed of the first stirring member for the detection of the amount of the toner remainder, it is possible to reduce in fluidity the toner in the developer container 41. With the toner reduced in fluidity, the length of time it takes for the toner to re-cover the light transmission window after the wiping of the surface of the light transmission window by the sheet portion 42A as the actual toner stirring portion, is relatively consistent, and therefore, the length of time the detection light is allowed to transmit through the developer container 41 remains relatively consistent, making it possible to accurately detect the amount of the toner remainder in the developer container 41, than prior to the reduction in the fluidity of the toner.

Further, the sequence, in this embodiment, for detecting the amount of the toner remainder in the toner container is provided with two referential values Ts, with which the cumulative length of time of the rotation of the development roller 40 is compared to change the length of the toner remainder amount detection interval according to the amount of toner consumption. With the employment of this setup, if a given image forming operation is relatively high in the amount of toner consumption, that is, it is higher in the amount by which the toner remainder reduces, the interval to the next time at which the sequence is to be carried out is shortened, for the following reason. That is, if an image forming operation interrupted for detecting the amount of the toner remainder has been relatively high in the amount of toner consumption, the remaining portion of the interrupted image forming operation may be expected to be relatively high in the amount of toner consumption after it is restarted. However, if the rest of the image forming operation happens to be lower in the amount of toner consumption than expected, that is, if it is smaller in the amount by which the toner remainder reduces, the interval to the time at which the sequence is carried next time is reduced in length may be switched back to the original value; in other words, the interval may be increased in length, for the following reason. That is, if an image forming operation interrupted for detecting the amount of the toner remainder has been relatively low in the amount of toner consumption, the remaining portion of the image forming operation may be expected to be relatively low in the amount of toner consumption after it is restarted. With the employment of the above described control method, it does not occur that the reduction in length the intervals with which the amount of the toner remainder is detected unnecessarily reduces an image forming apparatus in productivity.

In this embodiment, the normal referential value Ts1, with which the cumulative length of time of the rotation of the development roller 40 is compared to interrupt an on-going image forming operation to start the sequence for detecting the amount of the toner remainder at the end of the on-going image forming operation, is 220 seconds (Ts1), and the referential value Ts2, with which the cumulative length of time of the rotation of the development roller 40 is to be compared to reduce in length the intervals with which the sequence is carried out is 120 seconds (Ts2).

At this time, the method, in this embodiment, for determining the amount of toner consumption will be described. That is, the difference between the amounts (in percentage) of the toner remainder detected by two toner remainder amount detection sequences consecutively carried out with a preset interval is obtained.

Then, if the difference is greater than a preset threshold value N (7% in this embodiment), an on-going image forming operation is determined to be an image forming operation which is high in the amount of toner consumption, and the referential value Ts2 (which in this embodiment is 120 seconds) is selected as the value to which the cumulative length of the rotation of the development roller 40 is compared to trigger the toner remainder amount detection sequence. In other words, the toner remainder amount detection interval is reduced. If the above described difference happens to be come smaller than a preset threshold value M, which is different from the preset threshold value N, (which in this embodiment is 4%), the on-going image forming operation is determined to be small in the amount of toner consumption, and the referential value Ts is restored to the value Ts1 (which in this embodiment is 220 seconds), that is, the toner remainder amount detection interval is increased in length.

Figure 9:
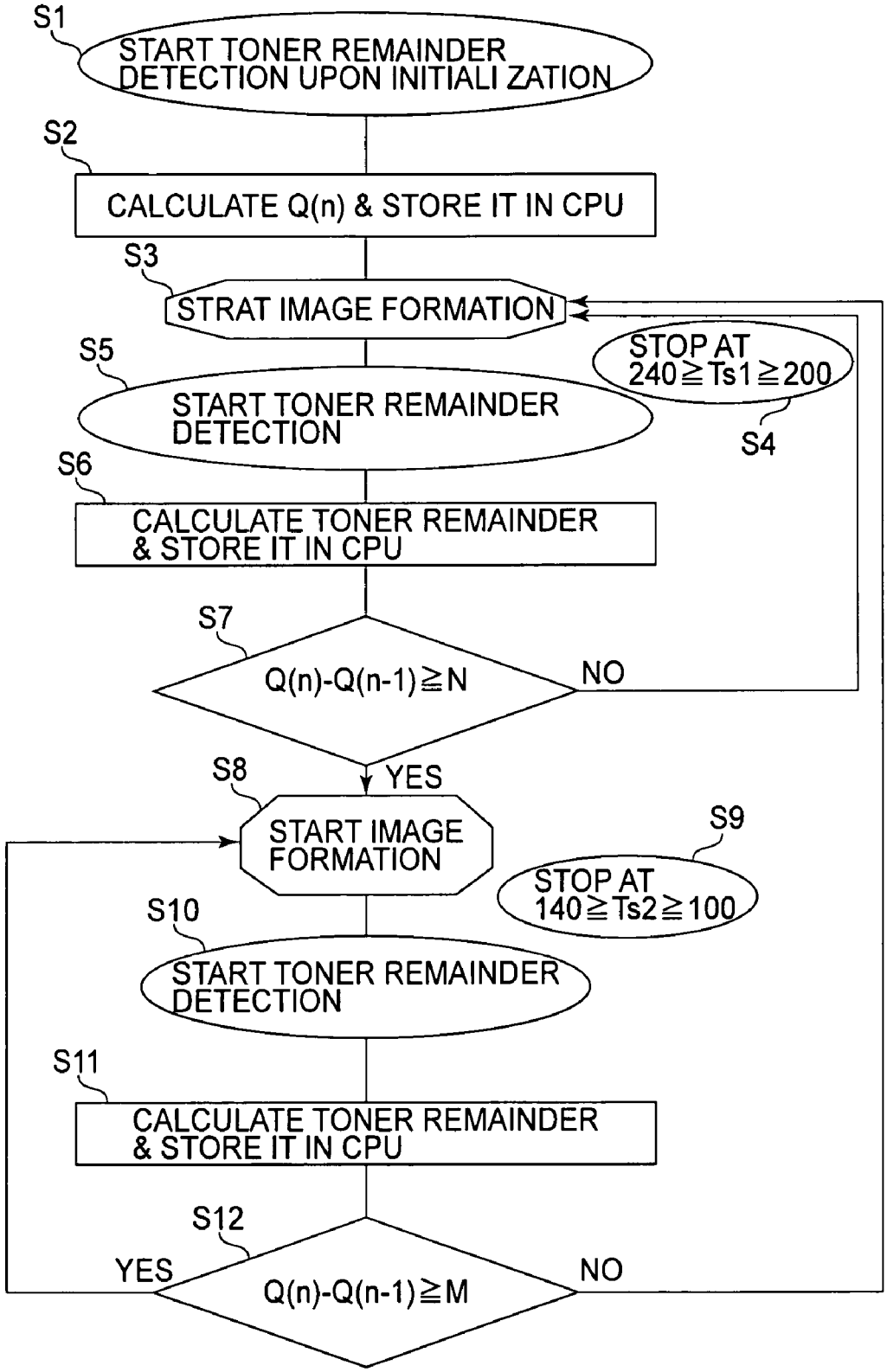
FIG. 9 is a flowchart of the toner remainder amount detection sequence in the first embodiment of the present invention.

Next, referring to the flowchart given in FIG. 9, the sequence, in this embodiment, for detecting the amount of the toner remainder in the toner container, will be described:

S1: The toner remainder amount detection is started in the initialization process (which is carried out immediately after the image forming apparatus is turned on, or immediately after the front cover of the apparatus main assembly is closed after the process cartridge is replaced, or paper jam or the like is dealt with).

S2: Toner remainder amount detection sequence is carried out to calculate the amount $Q_{(n)}$ (in percentage) of the toner remainder, based on the length of time the detection light is allowed to transmit through the toner container. The calculated amount of the toner remainder is stored in the CPU of the image forming apparatus (here, n stands for the number of times the sequence is repeated, and is reset each time the initialization process is carried out).

S3: An image forming operation is started.

S4: As the cumulative length of time of the development roller rotation reaches the value Ts1 which is in the range from 200 seconds to 240 seconds, the image forming operation is stopped. In this embodiment, the image forming operation is stopped as the cumulative length of time of the development roller rotation reaches 220 seconds (Ts1).

S5: The toner remainder amount detection is started.

S6: The toner remainder amount detection sequence is carried out to calculate the amount $Q_{(n)}$ (in percentage) of the toner remainder, based on the length of time the detection light is allowed to transmit through the toner container. The calculated amount is stored in the CPU of the image forming apparatus.

S7: If $Q_{(n)}-Q_{(n-1)} \leqq N$ (=7), that is, if the amount of toner consumption is high, Step S8 is taken. If $Q_{(n)}-Q_{(n\mp1)}<N$, that is, if the amount of toner consumption is low, Step S3 is taken. Here, N stands for a threshold value for evaluating the amount of toner consumption.

S8: The image forming operation is started.

S9: As the cumulative length of time of the development roller rotation reaches the value Ts2 which is in the range from 100 seconds to 140 seconds, the image forming operation is stopped. In this embodiment, the image forming operation is stopped as the cumulative length of time of the development roller rotation reaches 120 seconds (Ts2).

S10: The toner remainder amount detection is started.

S11: The toner remainder amount detection sequence is carried out to calculate the amount $Q_{(n)}$ (in percentage) of the toner remainder, based on the length of time the detection light is allowed to transmit through the toner container. The calculated amount is stored in the CPU of the image forming apparatus.

S12: If $Q_{(n)}-Q_{(n-1)} \geqq M$ (=4), that is, if the amount of toner consumption is high, Step S8 is taken, in which the detection interval is kept shorter. If $Q_{(n)}-Q_{(n-1)}<M$, that is, if the amount of toner consumption is low, Step S3 is taken, in which the detection interval is increased in length. Here, M stands for another threshold value for evaluating the amount of toner consumption.

In this embodiment, the above described sequence for detecting the amount of the toner remainder is carried out. In other words, if a given image forming operation is determined to be relatively high in the amount of toner consumption, the toner remainder amount detection interval is reduced in length to reduce as much as possible the change in the amount (in percentage) of the toner consumption. Therefore, even in the case of an image forming apparatus which is high in the amount of toner consumption, the amount of the toner remainder can be precisely detected. Further, if the amount of toner consumption falls after the reduction in the length of the detection interval, the length of the following detection interval can be switched back to the initial length, that is, the interval can be increased in length. Therefore, it is possible to accurately detect the amount of the toner remainder without unnecessarily reducing the image forming apparatus in productivity.

Incidentally, the threshold values N and M used for evaluating the amount of toner consumption, the values Ts1 and Ts2 with which the cumulative length of time of the development roller rotation is compared to trigger the toner remainder amount detection sequence, and the speed at which the stirring member is rotated while an image is actually formed, and the speed at which the stirring member is rotated while the amount of the toner remainder is detected, have only to be selected to be optimal for the image forming apparatus selected for an intended image forming operation.

Further, the present invention is also applicable to an electrophotographic image forming apparatus which does not employ the process cartridge system. The effects of the application of the present invention to such an image forming apparatus are the same as those obtained by the image forming apparatus in this embodiment.

Embodiment 2

Next, the electrophotographic image forming apparatus in another embodiment of the present invention will be described.

The electrophotographic image forming apparatus 100 and process cartridge 7 in this embodiment are characterized in that they are basically identical to those in the first embodiment, except for the method used for determining the amount of toner consumption to change in length the toner remainder amount detection interval according to the amount of toner consumption. The effects of this embodiment are similar to those of the first embodiment. In this embodiment, the intervals with which the amount of the toner remainder is detected is changed in length, based on image formation information. More concretely, it is changed based on the printing ratio in the image formation information.

Since the electrophotographic image forming apparatus 100 and process cartridge 7 in this embodiment are virtually identical to those in the first embodiment, their detailed descriptions will not be given here. Also in this embodiment, the speed at which the stirring member is rotated while the amount of the toner remainder is detected is rendered slower than that while an image is actually formed.

Figure 11:
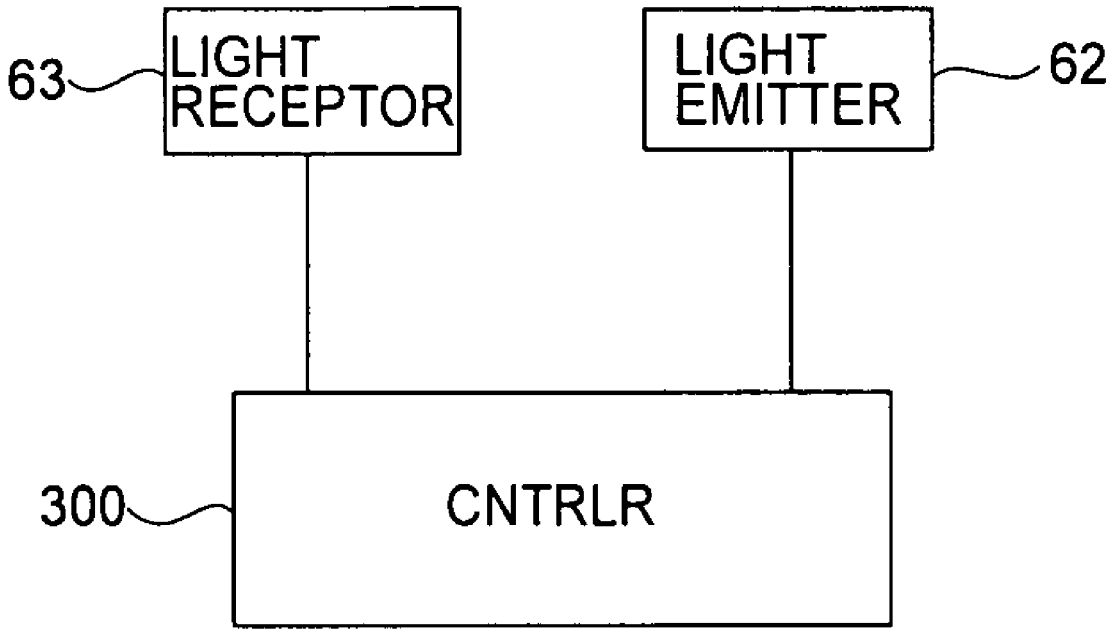
FIG. 11 is a block diagram of the toner remainder amount detecting means, showing the light emitting portion, light receiving portion, and controller.

The electrophotographic image forming apparatus 100 in this embodiment is provided with a controller 300 (FIGS. 1 and 11) for processing the image formation information (printing information), based on which an image is formed. The controller 300 is enabled to determine whether the toner amount detection interval should be reduced in length, or left normal. More specifically, it determines the print ratio from the inputted image formation information, and then, calculates the amount of toner consumption to determine whether the interval should be reduced in length or left normal. Referring to FIG. 11, which is a block diagram, to the controller 300, a light emitting portion 62 and a light receiving portion 63 are connected. Thus, the abovementioned signals, generated by the combination of light emitting portion 62 and light receiving portion 63 are inputted into the controller 300.

More specifically, if the inputted image formation information (printing information) indicates that the printing ratio is no less than P% (which in this embodiment is 35%), in other words, if the controller 300 determines that the on-going image forming operation is such an image forming operation that is large in the amount of toner consumption, the interval to the immediately following toner remainder amount detection is reduced in length. That is, the following detection sequence is carried out as the cumulative length of time of the rotation of the development roller 40 reaches the value Ts2 (which in this embodiment is 120 seconds). If the inputted image formation information (printing information) indicates that the printing ratio is no more than P% (which in this embodiment is 35%), in other words, if the controller 300 determines that the on-going image forming operation is such an image forming operation that is small in the amount of toner consumption, the interval to when the next toner remainder amount detection sequence is carried out is switched back to the normal length. That is, the following detection sequence is carried out as the cumulative length of the rotation of the development roller 40 reaches the value Ts1 (which in this embodiment is 220 seconds).

Figure 10:
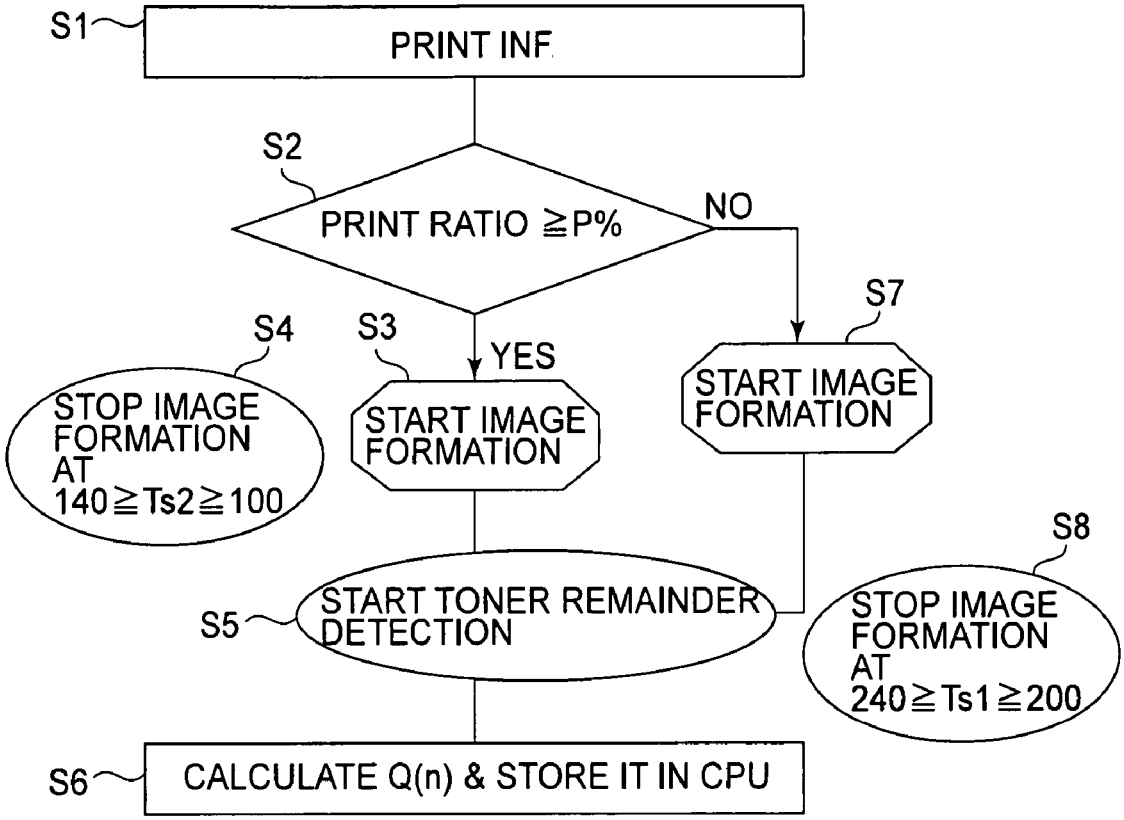
FIG. 10 is a flowchart of the toner remainder amount detection sequence in another embodiment of the present invention.

Next, referring to FIG. 10, which is a flowchart, the toner remainder amount detection sequence in this embodiment will be described:

S1: Printing information is inputted into the controller of the image forming apparatus.

S2: The controller determines whether or not the printing ratio is no less than P%. If it is no less than P%, Step S3 is taken. If it is no more than P%, Step S7 is taken. Here, P stands for a threshold value for evaluating the amount of toner consumption.

S3: The image forming operation is started.

S4: As the cumulative length of time of the development roller rotation reaches the value Ts1, which is in the range from 100 seconds to 140 seconds, the image forming operation is stopped. In this embodiment, the image forming operation is stopped as the cumulative length of time the development roller rotation reaches 120 seconds (Ts1=120 seconds).

S5: The toner remainder amount detection sequence is started.

S6: The toner remainder amount detection sequence is carried out to calculate the amount $Q_{(n)}$ (in percentage) of the toner remainder, based on the length of time the detection light is allowed to transmit through the toner container. The calculated amount is stored in the CPU of the image forming apparatus.

S7: The image forming operation is started.

S9: As the cumulative length of time of the development roller rotation reaches the value Ts1, which is in the range from 200 seconds to 240 seconds, the image forming operation is stopped. In this embodiment, the image forming operation is stopped as the cumulative length of the development roller rotation reaches 120 seconds (Ts2=120 seconds).

S10: The toner remainder amount detection is started. Then, Step S5 is taken.

In this embodiment, the above described sequence for detecting the amount of the toner remainder is carried out. In other words, if a given image forming operation is determined to be relatively large in the amount of toner consumption, the toner remainder amount detection interval is reduced in length to reduce as much as possible the change in the amount (in percentage) of the toner consumption, which occurs during the interval to when the detection sequence is carried out next. Therefore, even in the case of an image forming apparatus which is large in the amount of toner consumption, the amount of the toner remainder can be precisely detected. Further, if the amount of toner consumption falls after the reduction in the length of the detection interval, the length of the following detection interval can be switched back to the initial length, that is, it can be increased in length. Therefore, it is possible to accurately detect the amount of the toner remainder without unnecessarily reducing the image forming apparatus in productivity.

Incidentally, in the second embodiment, it is assumed that all of the inputted sets of image formation information are the same in printing ratio. However, the image formation information sets are not always the same printing ratio. Thus, if multiples sets of image formation information different in printing ratio are inputted in the same image forming operation, the highest printing ratio among the various printing ratios of the inputted sets of image formation information may be used as the abovementioned threshold value. For example, if a set of image formation information with a printing ratio of 20% (low printing ratio), and a set of image formation information with a print ratio of 80% (high printing ratio), are inputted together, the on-going image forming operation is assumed to be large in the amount of toner consumption (print ratio of 80% is chosen as printing ratio of on-going image forming operation), and therefore, the detection interval is reduced in length.

The threshold values P used for evaluating the amount of toner consumption, the values Ts1 and Ts2 as the values to be referenced to trigger the toner remainder amount detection sequence, the speed at which the stirring member is to be rotated while an image is actually formed, and the speed at which the stirring member is to be rotated while the amount of the toner remainder is detected, have only to be optimally selected according to the characteristics of the image forming apparatus used for an intended image forming operation. Further, in this embodiment, the cumulative length of time of the development roller rotation is used as the reference for setting the length of the toner remainder amount detection interval. However, the reference does not need to be limited to the cumulative length of the development roller rotation.

Further, the present invention is also applicable to an electrophotographic image forming apparatus which does not employ the process cartridge system. The effects of the application of the present invention to such an image forming apparatus are the same as those obtained by the image forming apparatus in this embodiment.

Further, the image forming apparatus in this embodiment is structured so that the stirring member for stirring toner rubs the light transmission window for detecting the amount of toner remainder. However, the application of the present invention is not limited to an image forming apparatus structured as described above.

Also in the preceding embodiments, the amount of the toner remainder in the toner container was detected by transmitting a beam of light through the toner container. However, the present invention is not limited in compatibility to such a toner remainder amount detecting method. For example, the present invention is also applicable to a case in which the toner remainder amount is determined by detecting the electrostatic capacity of the body of the toner in the toner container, and also, in which the rotational speed of the stirring member is lowered for the detection of the toner remainder amount, in order to raise the level of accuracy at which the toner remainder amount is detected.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 115989/2005 and 092581/2006 filed Apr. 13, 2005 and Mar. 29, 2006 which are hereby incorporated by reference.

What is claimed is:

1. An image forming apparatus comprising:

an image bearing member on which an electrostatic latent image is capable of being formed;

a developer accommodating container for accommodating a developer for developing the electrostatic latent image;

a detecting device for detecting a remaining amount of the developer in said developer accommodating container, wherein said detecting device detects the remaining amount during a period in which no image forming operation is performed; and a developer stirring member for stirring the developer in said developer accommodating container, said developer stirring member being rotatable at a speed which is lower during detection of the remaining amount than when an image forming operation is performed, wherein said detecting device detects first, second and third developer remaining amounts in first, second and third remaining amount detecting periods, respectively, in the order named, and wherein an interval between the second detection period and the third detection period is changed on the basis of the first and second remaining amounts, wherein said detecting device detects the remaining amount of developer by detecting light passing through a transmission port provided in said developer accommodating container.

2. An apparatus according to claim 1, wherein the interval is shortened when a difference between the first developer remaining amount and the second developer remaining amount is larger than a predetermined value.

3. An apparatus according to claim 1, wherein the interval is lengthened when a difference between the first developer remaining amount and the second developer remaining amount is smaller than a predetermined value.

4. An apparatus according to claim 1, wherein the first and second detection periods are continual.

5. An apparatus according to claim 1, comprising a developer carrying member for carrying the developer, wherein when the developer is supplied from said developer accommodating container onto said developer carrying member; the interval is determined on the basis of a cumulative number of rotations of said developer carrying member, and wherein the interval is changed by chasing the cumulative number of rotations.

6. An apparatus according to claim 1, wherein said developer stirring member contacts said transmission port.

7. An image forming apparatus comprising:

an image bearing member on which an electrostatic latent image is capable of being formed;

a developer accommodating container for accommodating a developer for developing the electrostatic latent image;

a detecting device for detecting a remaining amount of the developer in said developer accommodating container, wherein said detecting device detects the remaining amount during a period in which no image forming operation is performed; and a developer stirring member for stirring the developer in said developer accommodating container, said developer stirring member being rotatable at a speed which is lower during detection of the remaining amount than when an image forming operation is performed, wherein a time interval between a remaining amount detection of said detecting means and a subsequent remaining amount detection thereof is changed on the basis of image information, wherein said detecting device detects the remaining amount of developer by detecting light passing through a transmission port provided in said developer accommodating container.

8. An apparatus according to claim 7, further comprising a developer carrying member for carrying the developer, wherein when the developer is supplied from said developer accommodating container onto said developer carrying member, the interval is determined on the basis of a cumulative number of rotations of said developer carrying member, and wherein the interval is changed by changing the cumulative number of rotations.

9. An apparatus according to claim 7, wherein said developer stirring member contacts said transmission port.

* * * * *